US008309172B2

(12) United States Patent
Higaki et al.

(10) Patent No.: US 8,309,172 B2
(45) Date of Patent: Nov. 13, 2012

(54) METHOD AND DEVICE FOR COATING HOLLOW CYLINDRICAL MEMBER

(75) Inventors: Michitaka Higaki, Atsugi (JP); Takayuki Yoshii, Yokohama (JP); Tsuneaki Kondoh, Ayase (JP); Kohji Kamiya, Yokohama (JP); Hidenori Machida, Ebina (JP); Satoshi Tohkai, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 1136 days.

(21) Appl. No.: 12/155,719

(22) Filed: Jun. 9, 2008

(65) Prior Publication Data

US 2008/0311293 A1 Dec. 18, 2008

(30) Foreign Application Priority Data

Jun. 12, 2007 (JP) ..... 2007-155204

(51) Int. Cl.
*B05D 7/22* (2006.01)

(52) U.S. Cl. ..... 427/236; 427/424; 427/427.3

(58) Field of Classification Search ..... 427/231, 427/233, 236, 421.1, 424, 425, 427.3; 118/313–318, 118/320, 321, 323, DIG. 10, DIG. 11, DIG. 13
See application file for complete search history.

(56) References Cited

U.S. PATENT DOCUMENTS

| | | | | |
|---|---|---|---|---|
| 2,512,651 | A * | 6/1950 | Jacobs | 118/316 |
| 2007/0215045 | A1* | 9/2007 | Higaki et al. | 118/680 |
| 2008/0156259 | A1* | 7/2008 | Higaki et al. | 118/323 |
| 2008/0257258 | A1* | 10/2008 | Yajima et al. | 118/323 |

FOREIGN PATENT DOCUMENTS

| | | | |
|---|---|---|---|
| JP | 60-050537 | | 3/1985 |
| JP | 01-164483 | | 6/1989 |
| JP | 11-156294 | | 6/1999 |
| JP | 11-268058 | | 10/1999 |
| JP | 2000-061374 | | 2/2000 |
| JP | 2005-152830 | | 6/2005 |
| JP | 2005-313056 | | 11/2005 |
| JP | 2007-014879 | | 1/2007 |
| JP | 2007-014879 | A * | 1/2007 |
| JP | 2007-245072 | | 9/2007 |

OTHER PUBLICATIONS

Office Action for corresponding Japanese patent application No. 2007-155204 dated Sep. 13, 2011.

Office Action for corresponding Chinese patent application No. 200810110209.8 dated Oct. 12, 2010.

* cited by examiner

*Primary Examiner* — William Phillip Fletcher, III
(74) *Attorney, Agent, or Firm* — Harness, Dickey & Pierce, P.L.C.

(57) ABSTRACT

A method and a device for coating a hollow cylindrical member. The method includes radially coating an entire inner surface of the hollow cylindrical member with a first coating material discharged by a first slit nozzle and simultaneously circularly coating an entire outer surface of the hollow cylindrical member with a second coating material discharged in an axial direction of the hollow cylindrical member by a second slit nozzle located opposite the first slit nozzle with the hollow cylindrical member therebetween. The first slit nozzle and the second slit nozzle discharge the first coating material and the second coating material, respectively, to a same height of the hollow cylindrical member relative to the inner surface and the outer surface thereof.

6 Claims, 2 Drawing Sheets

METHOD AND DEVICE FOR COATING HOLLOW CYLINDRICAL MEMBER

CROSS-REFERENCE TO RELATED APPLICATION

This patent specification is based on and claims priority from Japanese Patent Application No. 2007-155204, filed on Jun. 12, 2007 in the Japan Patent Office, the entire contents of which are hereby incorporated by reference herein.

BACKGROUND

1. Field of the Invention

The present invention relates to a method and a device for coating a hollow cylindrical member.

2. Description of the Related Art

In a typical image forming apparatus such as a copier, a facsimile, or an LBP (laser beam printer) that uses electrophotography to form an image, a toner image transferred to transfer paper is melted on and fixed thereto when the transfer paper passes between a heated fixing member and a pressure member pressing against the fixing member.

The fixing member used in image fixing, such as a fixing roller or a fixing belt, typically includes a hollow cylindrical core formed of a metal such as aluminum or iron or an endless substrate formed of a resin such as polyimide or a metal such as nickel. The core or the substrate is coated with a heat-resistant elastic layer formed of silicone rubber and may then be tubularly covered or coated with a releasing layer formed of fluororesin.

The elastic layer functions to evenly press the toner against the transfer paper during image fixing, thereby reducing image graininess. In addition, the heat conductivity of the elastic layer affects a device startup time (i.e. the time required for the temperature to rise to a certain level). Therefore, it is desirable that the thickness of the elastic layer be uniform.

In a fixing device using such a fixing member, electrical conducting properties are imparted to the fixing member to improve fixing ability and prevent image density irregularities. Further, when a fixing belt is used as the fixing member with a supporting member contacting the inner surface of the fixing belt for structural reasons, tribological properties are imparted to the inner surface of the fixing belt so that the fixing belt is steadily driven.

A substrate included in the fixing member may have such properties. However, a substrate such as a metal substrate has poor tribological properties and therefore a coating material having the above-described properties is applied to the inner surface of the substrate.

However, in this case, processes of forming and drying the inner and outer coatings are sequentially performed, thereby increasing the man-hours required and the cost incurred. In addition, for the processes to be sequentially performed, the substrate, which is a hollow cylindrical member, needs to be positioned or held with high accuracy in different ways each time for internal coating and external coating, which makes the coating system expensive.

To solve the problems described above, development of a method for simultaneously coating the inner and outer surfaces of a hollow cylindrical member is proceeding.

The inner and outer coatings of the hollow cylindrical member often need to be of different materials and different thicknesses to have different properties as described above. Therefore, it is desirable that the inner and outer surfaces of the hollow cylindrical member be simultaneously coated with different coating materials. Consequently, a typical dip coating method in which the hollow cylindrical member is dipped in and out of a large coating tank is too simple to solve the above-described problems.

To facilitate an understanding of the state of the art and of the present invention typical methods known for coating either the outer or the inner surface of a hollow cylindrical member are described below.

The methods of coating the outer surface of a hollow cylindrical member include a dip coating method, a ring coating method, an annular curtain coating method, a spray coating method, a blade coating method, and a roller coating method. In addition to the above-described methods, the methods of coating the inner surface of a hollow cylindrical member include a coating method in which a coating material is discharged onto the inner surface of a rapidly rotating hollow cylindrical member so that the coating material is centrifugally pressed against the inner surface, and a coating method in which the inner surface of the hollow cylindrical member physically contacts the primarily coated outer surface of a coating pipe inserted into the hollow cylindrical member.

The inner and outer surfaces may be simultaneously coated by combining the coating methods described above. However, such coating causes a lack of uniformity in the thickness of the coating.

Typically, to form a flat, smooth, and uniform coating on the outer surface of a hollow cylindrical member by the ring coating method, there needs to be a constant gap CG (coating gap) between a slit of an annular coating head and the hollow cylindrical member, i.e. the hollow cylindrical member needs to be concentric with the annular coating head, over the entire coating area in the axial direction of the hollow cylindrical member.

Specifically, when the hollow cylindrical member is not concentric with the annular coating head, it is difficult to form a uniform and highly accurate coating over the entire coating area. The thickness of the coating varies along the circumferential direction of the hollow cylindrical member, and an uneven circumferential shear force is applied to the hollow cylindrical member and causes small bubbles or vertical streaks to form in the coating. Therefore, the hollow cylindrical member needs to be positioned with high accuracy to be coaxial with the annular coating head. However, such coaxial arrangement cannot be achieved with a flexible substrate such as an endless belt since simultaneous coating of the inner and outer surfaces does not allow the use of a core, which is effective for configuring the coaxial arrangement, on the inner surface of the flexible substrate.

The coaxial arrangement is also required during movement of the annular coating head relative to the hollow cylindrical member. Therefore, the annular coating head needs to be driven vertically with high accuracy, which increases the device cost.

SUMMARY

Described herein is a novel method of coating a hollow cylindrical member that includes radially coating an entire inner surface of the hollow cylindrical member with a first coating material discharged by a first slit nozzle and simultaneously circularly coating an entire outer surface of the hollow cylindrical member with a second coating material discharged in an axial direction of the hollow cylindrical member by a second slit nozzle located opposite the first slit nozzle with the hollow cylindrical member therebetween. The first slit nozzle and the second slit nozzle discharge the first coating material and the second coating material, respectively, to a same height of the hollow cylindrical member relative to the inner surface and the outer surface thereof.

Further described herein is a novel device for coating a hollow cylindrical member that includes a holder to hold the hollow cylindrical member to maintain an axis thereof vertical, a first slit nozzle located facing an inner surface of the hollow cylindrical member to radially discharge a first coating material to an entire inner surface of the hollow cylindrical member, a second slit nozzle located opposite the first slit nozzle while facing an outer surface of the hollow cylindrical member to circularly discharge a second coating material in the axial direction of the hollow cylindrical member to an entire outer surface of the hollow cylindrical member, and at least one coating material supply unit to supply the first coating material and the second coating material to the first slit nozzle and the second slit nozzle.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
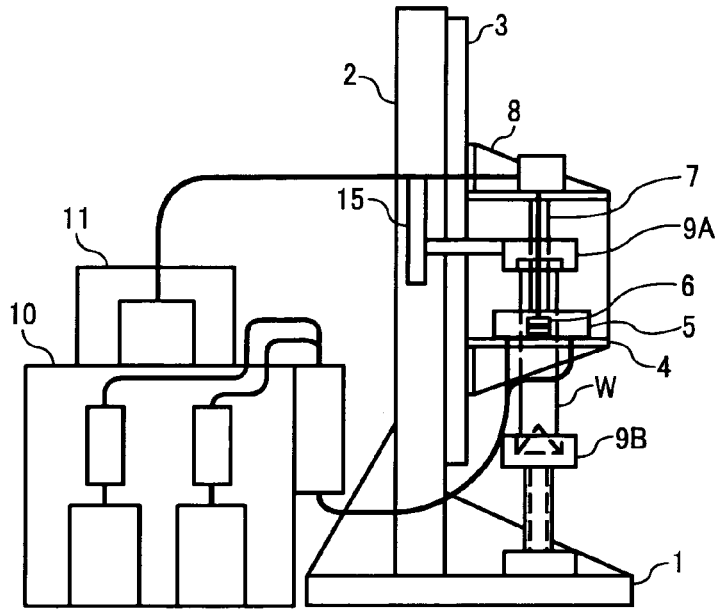
FIG. 1 is a schematic diagram illustrating an example coating device for coating a hollow cylindrical member using a method of coating a hollow cylindrical member according to a first embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals and reference characters designate identical or corresponding parts throughout the several views thereof, particularly to FIG. 1, a method and a device for coating a hollow cylindrical member according to exemplary embodiments of the present invention are described.

Referring to FIGS. 1 through 4, a coating method of coating a hollow cylindrical member according to a first embodiment of the present invention is described.

FIG. 1 is a schematic diagram illustrating an overall configuration of a coating device for coating a hollow cylindrical member according to the first embodiment of the present invention.

In FIG. 1, the coating device includes a base 1, a columnar rear base 2 vertically mounted on the base 1, an actuator 3 attached to the rear base 2 and producing vertical movement, and support beams 4 and 8 that are driven vertically by the actuator 3 and retractable to allow insertion or removal of a hollow cylindrical member W to be coated into or from the coating device.

Specifically, the hollow cylindrical member W is easily inserted into and removed from the coating device before and after coating by moving (retracting) coating heads 5 and 6 and a member holder 9A to a position above the top of the hollow cylindrical member W by using the actuator 3 and an actuator 15 attached to the rear base 2.

The coating head 6 is suspended from the support beam 8 by an arm 7 attached to the support beam 8 and extending downward, and includes a first slit nozzle 6*a* (see FIG. 3) located facing the inner surface of the hollow cylindrical member W inserted into the coating device to be coated. The first slit nozzle 6*a* radially discharges a first coating material Mb to an entire inner surface of the hollow cylindrical member W.

The coating head 5 is located on and above the support beam 4. The coating head 5 includes a second slit nozzle 5*a* (see FIG. 3) that is located facing the outer surface of the hollow cylindrical member W and circularly discharges a second coating material Ma in the axial direction of the hollow cylindrical member W to an entire outer surface of the hollow cylindrical member W.

In the first embodiment, the second slit nozzle 5*a* is located opposite the first slit nozzle 6*a*, and the first slit nozzle 6*a* and the second slit nozzle 5*a* are located at substantially a same height.

The hollow cylindrical member W is placed on a member holder 9B located on the base 1. The member holder 9B is moved vertically by an actuator, not shown, provided therein.

Figure 2:
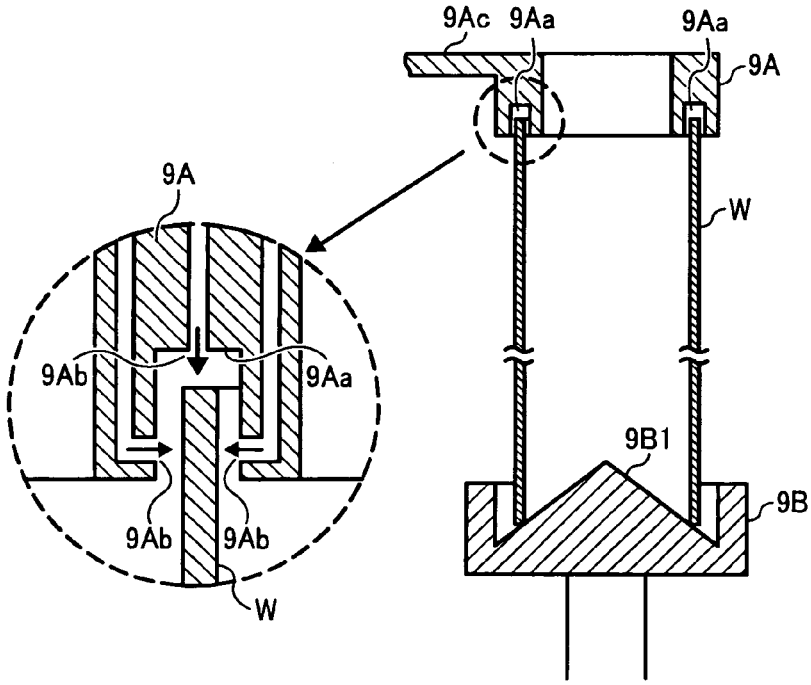
FIG. 2 is a schematic diagram illustrating a hollow cylindrical member placed in the coating device of FIG. 1.

FIG. 2 illustrates the hollow cylindrical member W placed in the coating device. The member holder 9B includes a conical holder 9B1 on which the hollow cylindrical member W is placed coaxially with the conical holder 9B1.

The top portion of the hollow cylindrical member W is held by the member holder 9A. While a heavy hollow cylindrical member W moves with the member holder 9B, a light hollow cylindrical member W such as a substrate for a fixing belt may not move with the member holder 9B due to, for example, an effect of a coating material discharged from a nozzle (the effect is especially noticeable with a coating material with high viscosity). The member holder 9A is thus useful for such a light hollow cylindrical member W.

The member holder 9A is connected to the actuator 15 via an arm 9Ac in such a way that the axis of the member holder 9A is aligned vertically. The member holder 9A is vertically driven in sync with the member holder 9B.

The hollow cylindrical member W is held in such a way that the top portion of the hollow cylindrical member W engages an annular groove 9Aa located at the bottom of the member holder 9A. In addition, the top portion of the hollow cylindrical member W is loosely held by a flow of compressed air supplied from a compressor, not shown, through three air outlets 9Ab provided so that the air presses the hollow cylindrical member W down against the conical holder 9B1.

The first slit nozzle 6*a* is immersed in a coating material supply unit 11 including a coating tank. The first coating material Mb is prepared and supplied from the coating tank to the first slit nozzle 6*a* using a metering pump, not shown.

The second slit nozzle 5*a* is immersed in a coating material supply unit 10. The coating material supply unit 10 in the first embodiment includes two coating tanks containing different coating materials. The coating materials are sent to a mixing unit by metering pumps connected to the two tanks, respectively, and evenly mixed in the mixing unit to prepare the second coating material Ma to be supplied to the second slit nozzle 5*a*.

Figure 3:
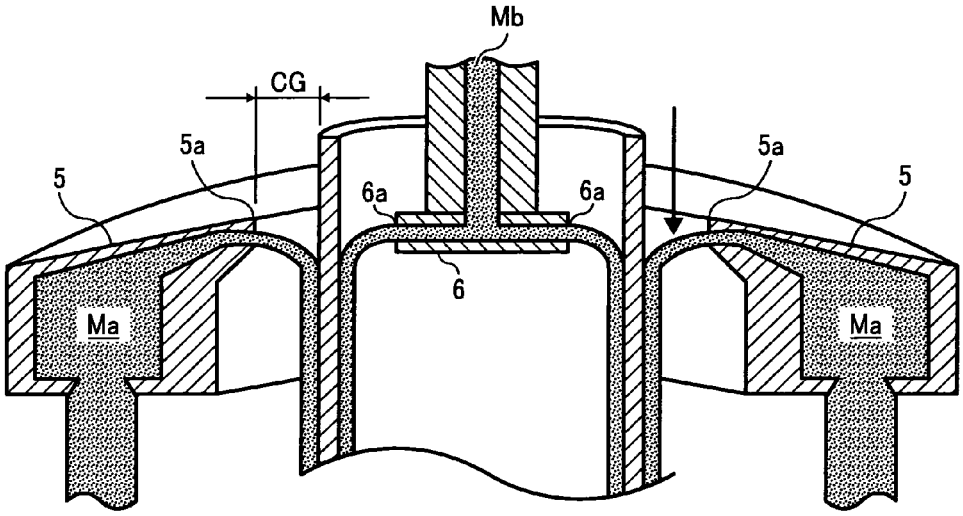
FIG. 3 is a schematic diagram illustrating an example of simultaneous coating by the coating device of FIG. 1.

FIG. 3 is a schematic diagram illustrating an example of simultaneous coating by the coating device of FIG. 1 according to the first embodiment. In the first embodiment, the axis of the hollow cylindrical member W is maintained vertical during simultaneous coating of the inner and outer surfaces of the hollow cylindrical member W. Specifically, the inner and outer surfaces of the hollow cylindrical member W are simultaneously coated by the coating method that includes radially coating the entire inner surface of the hollow cylindrical member W with the first coating material Mb discharged by the first slit nozzle 6*a* that is included in the coating head 6 and is located facing the inner surface of the hollow cylindrical member W, and simultaneously circularly coating the entire outer surface of the hollow cylindrical member W with the second coating material Ma discharged in the axial direction of the hollow cylindrical member W by the second slit nozzle 5*a* that is included in the coating head 5 and is located opposite the first slit nozzle 6*a* with the hollow cylindrical member W therebetween. The first slit nozzle 6*a* and the second slit nozzle 5*a* discharge the first coating material Mb and the second coating material Ma to a same height of the hollow cylindrical member W relative to the inner surface and the outer surface thereof. In the first embodiment, the inner and outer surfaces of the hollow cylindrical member W are simultaneously coated by the nozzles 5*a* and 6*a* discharging the coating materials in the form of a film or curtain while the hollow cylindrical member W, which is held by the member holders 9B and 9A that are synchronously driven by the actuator, moves vertically downward.

The first slit nozzle 6*a* and the second slit nozzle 5*a* discharge the first coating material Mb and the second coating material Ma to a same height of the hollow cylindrical member W relative to the inner surface and the outer surface thereof by controlling the amounts of the coating materials supplied by the metering pumps of the coating material supply units 10 and 11. Specifically, the amounts of the two coating materials are controlled so that the two coating materials meet at a position intermediate between the inner and outer peripheries of the hollow cylindrical member W.

The amounts of the two coating materials can be controlled, if necessary, by using a hollow cylindrical member formed of a transparent material in the same form as the hollow cylindrical member W to be coated and then visually checking the discharge state of the coating materials. In addition, the discharge state can be simulated by using a formula for horizontal projection as an approximation.

By controlling the discharge amounts, the first slit nozzle 6*a* and the second slit nozzle 5*a* discharge the first coating material Mb and the second coating material Ma respectively in the form of a film to a same height of the hollow cylindrical member W relative to the inner surface and the outer surface thereof so that the inner and outer surfaces of the hollow cylindrical member W are simultaneously coated at the same height. Also, the forces applied to the inner and outer surfaces of the hollow cylindrical member W to be coated are balanced by the coating materials, thereby preventing deformation of the coated portion and achieving uniform coating even when the hollow cylindrical member W is formed of a flexible material such as an endless belt substrate.

As described above, the top portion of the hollow cylindrical member W is loosely held by the member holder 9A by a flow of compressed air. Therefore, when the hollow cylindrical member W is not coaxial with the nozzles 5*a* and 6*a* during coating the hollow cylindrical member W returns to a coaxial position by receiving discharge pressure of the coating materials, thereby forming even coatings on the entire inner and outer surfaces.

The simultaneous coating illustrated in FIG. 3 is curtain coating performed by applying the discharged coating materials in the form of a film. The gap (CG illustrated in FIG. 3) between the end of the nozzle 5*a* and the hollow cylindrical member W is relatively large (at or above 1.5 times the thickness of the coating formed) and the coating materials discharged from the nozzles 5*a* and 6*a* come into contact with the hollow cylindrical member W in the form of a film (curtain).

In this case, the coating materials are selected in consideration of their properties, particularly their viscosity, to form a film (curtain).

Figure 4:
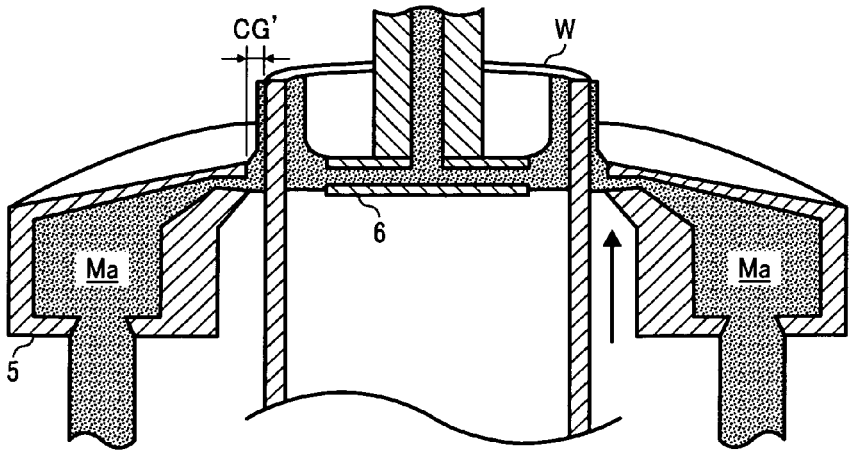
FIG. 4 is a schematic diagram illustrating another example of simultaneous coating according to a second embodiment of the present invention.

A coating method according to a second embodiment of the present invention is now described with reference to FIG. 4. This coating method is available for a coating material with a relatively wide viscosity range. The coating device is the same as that described above, except for the coating heads.

In this case, the gap (CG' illustrated in FIG. 4) between the end of the nozzle 5*a* and the hollow cylindrical member W is smaller than in the curtain coating illustrated in FIG. 3. The coating materials are discharged from the nozzles and immediately applied to the hollow cylindrical member W at the same height. Further, in the second embodiment, coating is performed while the hollow cylindrical member W, which is held by the member holders 9A and 9B that are synchronously driven, moves vertically upward.

Also, in the second embodiment, the inner and outer surfaces of the hollow cylindrical member W are coated at the same height, thereby minimizing the effect of the pressure of the coating materials discharged from the nozzles 5*a* and 6*a*. Therefore, coaxial positions of the nozzles 5*a* and 6*a* and the hollow cylindrical member W are maintained and even coatings are formed.

It should be noted that although the hollow cylindrical member W is coated by fixing the coating heads 5 and 6 and vertically moving the hollow cylindrical member W in the above-described embodiments, alternatively the hollow cylindrical member W can be coated by fixing the hollow cylindrical member W and vertically moving the coating heads 5 and 6. Further, the hollow cylindrical member W can be coated by vertically moving the hollow cylindrical member W and the coating heads 5 and 6 in the opposite directions. However, it is preferable that the hollow cylindrical member W be coated by fixing the coating heads 5 and 6 and vertically moving the hollow cylindrical member W since the coating heads 5 and 6 are relatively heavy and therefore the device cost is reduced and the positional accuracy of the coating heads 5 and 6 is easily increased by fixing the coating heads 5 and 6. Also, in this case, the effect of vibration of the actuators driving the coating heads and the accuracy of the rear base on the accuracy of coating is eliminated.

As can be understood by those skilled in the art, numerous additional modifications and variations are possible in light of the above teachings. It is therefore to be understood that, within the scope of the appended claims, the disclosure of this patent specification may be practiced otherwise than as specifically described herein.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program or computer program product. For example, the aforementioned methods may be embodied in the form of a system or device, including, but not limited to, any of the structures for performing the methodology illustrated in the drawings.

Example embodiments being thus described, it will be apparent that the same may be varied in many ways. Such variations are not to be regarded as a departure from the spirit and scope of the present invention, and all such modifications as would be obvious to one skilled in the art are intended to be included within the scope of the following claims.

What is claimed is:

1. A method of coating a hollow cylindrical member comprising:

radially coating an entire inner surface of the hollow cylindrical member with a first coating material discharged by a first slit nozzle;

simultaneously circularly coating an entire outer surface of the hollow cylindrical member with a second coating material discharged in an axial direction of the hollow cylindrical member by a second slit nozzle located opposite the first slit nozzle with the hollow cylindrical member therebetween; and moving the hollow cylindrical member in a vertical direction during coating, wherein the first slit nozzle and the second slit nozzle discharge the first coating material and the second coating material to a same height of the hollow cylindrical member relative to the inner surface and the outer surface thereof.

2. The method of coating a hollow cylindrical member according to claim 1, further comprising holding the hollow cylindrical member in place by a flow of compressed air.

3. The method of coating a hollow cylindrical member according to claim 1, wherein the hollow cylindrical member is open at each end.

4. The method of coating a hollow cylindrical member according to claim 1, wherein circularly coating includes discharging the second coating material from a single second slit that extends around the outer periphery of the hollow cylindrical member.

5. The method of coating a hollow cylindrical member according to claim 1, further comprising controlling amounts of the first coating material and the second coating material such that the two coating materials meet at a position intermediate between the inner and outer peripheries of the hollow cylindrical member.

6. The method of coating a hollow cylindrical member according to claim 1, wherein the first slit nozzle and the second slit nozzle are located at a same height.

* * * * *